US010224640B2

(12) United States Patent
LeBayon et al.

(10) Patent No.: US 10,224,640 B2
(45) Date of Patent: Mar. 5, 2019

(54) RADOME FOR AN ANTENNA WITH A CONCAVE-REFLECTOR

(71) Applicant: Alcatel Lucent, Boulogne Billancourt (FR)

(72) Inventors: Armel LeBayon, Trignac (FR); Denis Tuau, Trignac (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 14/890,701

(22) PCT Filed: May 14, 2014

(86) PCT No.: PCT/IB2014/061437

§ 371 (c)(1),
(2) Date: Nov. 12, 2015

(87) PCT Pub. No.: WO2014/184755

PCT Pub. Date: Nov. 20, 2014

(65) Prior Publication Data

US 2016/0087345 A1 Mar. 24, 2016

(30) Foreign Application Priority Data

May 15, 2013 (EP) ..... 13305610

(51) Int. Cl.
*H01Q 19/12* (2006.01)
*H01Q 19/13* (2006.01)
(Continued)

(52) U.S. Cl.
CPC ..... *H01Q 19/13* (2013.01); *H01Q 1/42* (2013.01); *H01Q 17/001* (2013.01);
(Continued)

(58) Field of Classification Search
CPC ..... H01Q 19/12; H01Q 19/13; H01Q 19/19; H01Q 1/288; H01Q 3/20
(Continued)

(56) References Cited

U.S. PATENT DOCUMENTS

2005/0035923 A1 2/2005 Syed et al.
2006/0238404 A1 10/2006 Ikeda
(Continued)

FOREIGN PATENT DOCUMENTS

CN 1808173 7/2006
CN 102232258 A1 11/2011
(Continued)

OTHER PUBLICATIONS

International Search Report for PCT/IB2014/061437 dated Feb. 17, 2015.

*Primary Examiner* — Dameon E Levi
*Assistant Examiner* — Collin Dawkins
(74) *Attorney, Agent, or Firm* — Fay Sharpe LLP

(57) ABSTRACT

A radome for a concave-reflector antenna is fastened directly onto the reflector's edge. The inner surface of the radome comprises at least one absorbent part partially covering its surface area and disposed along its peripheral edge. The surface area of the radome covered by the absorbent part(s) is less than 15% of the total surface area. The radome may comprise two absorbent parts in diametrically opposite positions. Each absorbent part may have a substantially triangular shape, the base of the absorbent part being rounded along the radome's edge, and a portion of its surface area having been removed laterally from each side of the triangle in a circular arc cut-out.

11 Claims, 6 Drawing Sheets

Figure 1:
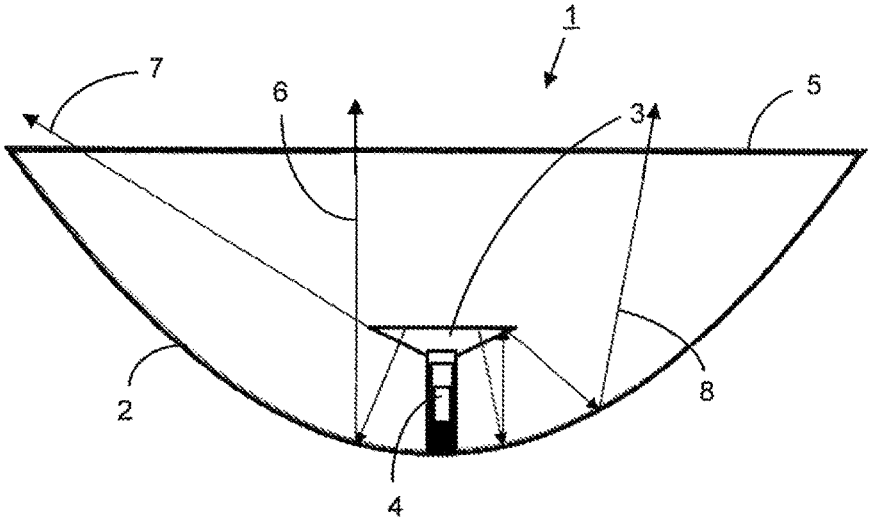

(51) Int. Cl.

| | |
|---|---|
| ***H01Q 1/42*** | (2006.01) |
| ***H01Q 17/00*** | (2006.01) |
| ***H01Q 19/02*** | (2006.01) |
| ***H01Q 19/19*** | (2006.01) |

(52) U.S. Cl.
CPC ..... *H01Q 17/008* (2013.01); *H01Q 19/026* (2013.01); *H01Q 19/19* (2013.01)

(58) Field of Classification Search
USPC ... 343/840, 914, 781 CA, 755, 781 R, 781 P
See application file for complete search history.

(56) References Cited

U.S. PATENT DOCUMENTS

| | | | | |
|---|---|---|---|---|
| 2011/0234468 | A1* | 9/2011 | Omuro ..... | H01Q 1/40<br>343/840 |
| 2012/0306712 | A1* | 12/2012 | Iwanaka ..... | H01Q 15/14<br>343/781 P |

FOREIGN PATENT DOCUMENTS

| | | | | |
|---|---|---|---|---|
| CN | 102754279 | | 10/2012 | |
| DE | 4219582 | A1 | 12/1993 | |
| EP | 2466688 | * | 6/2012 | ..... H01Q 19/02 |
| EP | 2804259 | A1 | 11/2014 | |
| FR | 2671235 | B1 | 8/1993 | |
| WO | WO 2014/184755 | A2 | 11/2014 | |

* cited by examiner

RADOME FOR AN ANTENNA WITH A CONCAVE-REFLECTOR

The present invention pertains to a telecommunication antenna with a concave reflector having, for example, the shape of at least one parabola portion. These antennas, particularly microwave antennas, are commonly used in mobile communication networks. These antennas operate equally well in transmitter mode or in receiver mode, corresponding to two opposite directions of RF wave propagation.

BACKGROUND

In parabolic reflector antennas, the value of the reflector's diameter is determined by the central operating frequency of the antenna. The lower the antenna's operating frequency, the greater the reflector's diameter, assuming equivalent antenna gain. For deep reflector antennas, the F/D ratio is less than or equal to 0.25. In this report, F is the focal distance of the reflector (the distance between the reflector's apex and its focus) and D is the reflector's diameter. These antennas exhibit high spillover losses and decrease the antenna's front-to-back ratio. Spillover losses lead to environmental pollution through RF waves and must be limited to levels defined by standards.

One common solution is to attach to the periphery of the parabolic reflector a cylindrical wall, also known as a shroud, with a diameter neighboring that of the reflector and which is of a suitable height, most commonly covered with a material that absorbs RF radiation. The use of an expensive absorbent shroud is necessary in order to limit the spillover effect and improve the antenna's performance. Nonetheless, the solution increases the cost and dimensions of the antenna, and makes packaging for transport more complicated.

Furthermore, the presence of the shroud increases the antenna's wind-catching surface and the risk of accumulation of polluting agents. For this reason, the shroud is associated with a radome which exhibits an impermeable protective surface closing off the space defined by the reflector and the shroud from the outside. This radome can be flexible or rigid, flat or not, and in any shape whatsoever. A circular rigid radome, the most commonly used kind today, offers the advantage of good resistance to the outside climate conditions, such as rain, wind, or snow.

SUMMARY

To eliminate these drawbacks, it is proposed to remove the shroud. However, in the absence of a shroud, the antenna's lateral radiation persists, and may cause spillover. It is therefore desired to limit this spillover, while maintaining performance at the same level as in known microwave antennas that have a parabolic reflector equipped with a shroud.

The purpose is therefore to propose a radome that makes it possible to obtain a radiation pattern that leads to satisfactory performance, in accordance with existing standards, with a low impact on the antenna's gain.

The subject matter of the present invention is an antenna with a concave reflector having a circular opening with a peripheral edge, the reflector being protected by a radome fixed directly onto the peripheral edge of the reflector, the radome comprising an inner surface turned towards the reflector, wherein at least one absorbent part, applied onto the inner surface of the radome and disposed along the peripheral edge of the reflector, has a substantially triangular shape of which the point is directed towards the center of the reflector and the base is rounded along the peripheral edge of the reflector.

The radome is "fastened directly onto the edge of the reflector" because the reflector does not comprise a shroud, so the radome is not attached to a shroud, but rather directly to the reflector.

Preferably, the surface area of the radome covered by the absorbent part(s) is less than 15% of the total surface area. The absorbent parts are disposed along the peripheral edge of the reflector, leaving an empty area at the center of the reflector.

According to a first aspect, the absorbent parts are disposed in a ring formed by a succession of triangles. The absorbent part has a substantially triangular shape, the base of the absorbent part being rounded along the edge of the radome.

According to a second aspect, the absorbent parts are in a diametrically opposed position.

According to one preferred embodiment, the absorbent part substantially has the shape of a triangle from which some of the side surface area has been removed. The absorbent part has a lower surface area than the triangle attaching the base to the peak. The shape is substantially triangular, with some of the surface area of the absorbent part having been removed from the side, the base of the absorbent part following the edge of the radome.

According to one variant, the sides of the triangle form a circular arc. The removed surface portion is constituted by the elimination of surface areas on each side of the triangle in a cut-out circular arc.

According to another variant, the sides of the triangle form an inside corner. The removed surface portion is constituted by the elimination of surface areas on each side of the triangle in a cut-out isosceles triangle.

Preferably, the radome comprises two absorbent parts in a diametrically opposed position.

The radome has been modified by adding parts that constitute an absorbent material with a shape specially designed to reduce the spillover and at least preserve the performance of the radiation pattern with the lowest impact on gain, without it being necessary to add a shroud.

According to one embodiment, the length of the base of the absorbent part is between D/5 and 2D/5, where D is the diameter of the radome.

According to another embodiment, the ratio of the length of the absorbent part's base to the absorbent part's height is between 1 and 2.

A further subject matter of the invention is a concave-reflector antenna comprising a radome fastened directly onto the edge of the reflector, the inner surface of the radome comprising at least one absorbent part partially covering its surface and disposed along its peripheral edge.

According to one particular embodiment, the radome is circular, flat, and rigid.

A low-spillover microwave antenna is a guarantee of transmission/reception quality because it makes it possible to create a radio link with very low interference between neighboring antennas, in particular in a high antenna density area. Furthermore, this antenna is less expensive, smaller in size, and easier to transport than antennas of the prior art.

BRIEF DESCRIPTION

Figure 2:
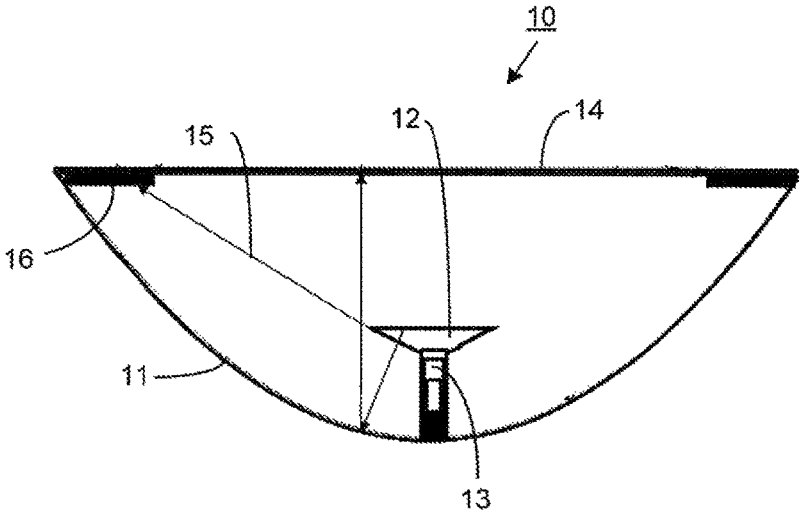
Figure 3:
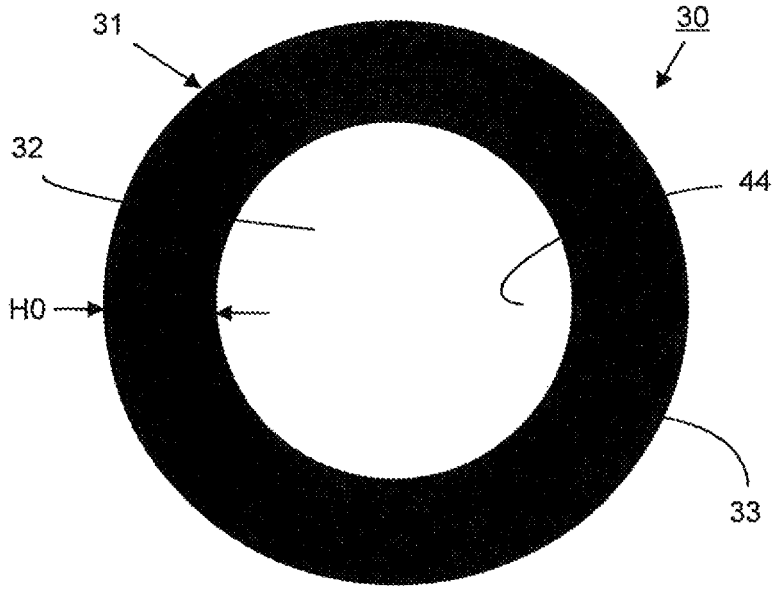
Figure 4:
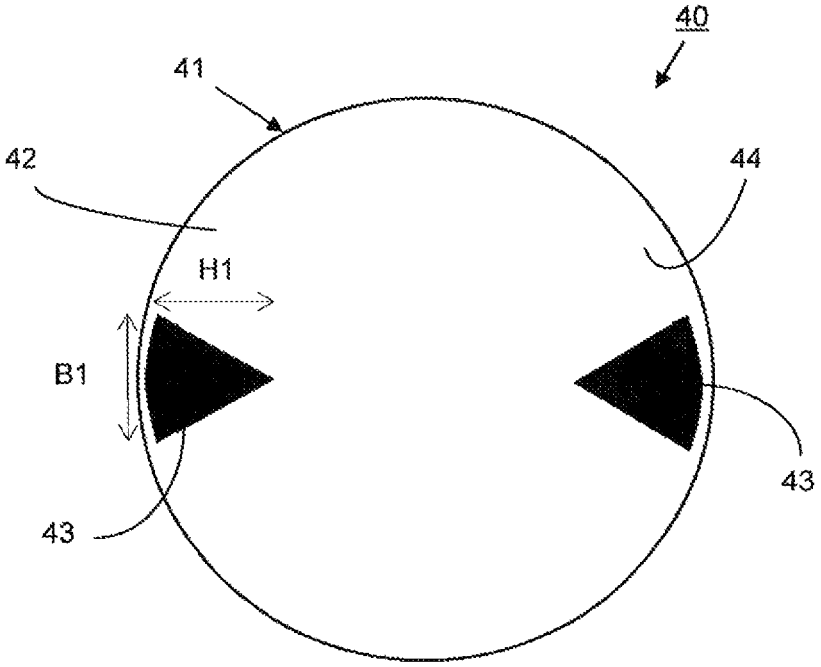
Figure 5:
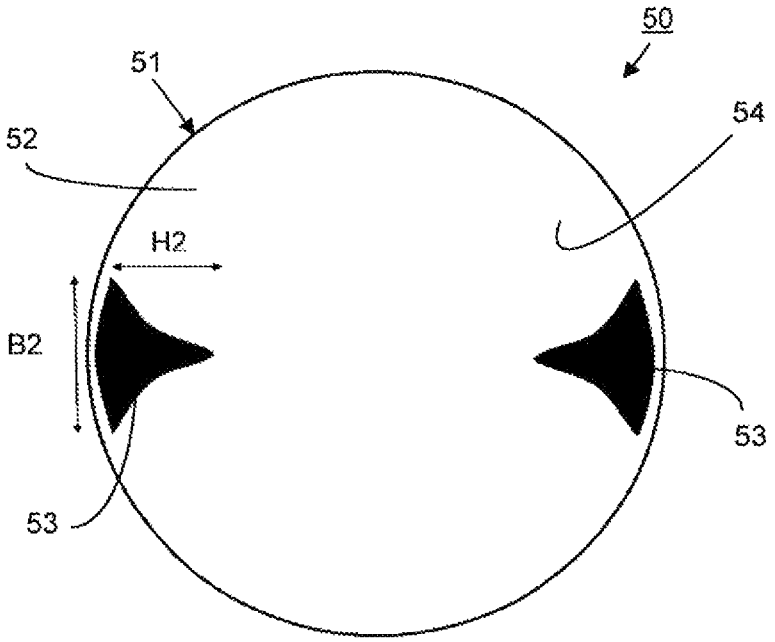
Figure 6:
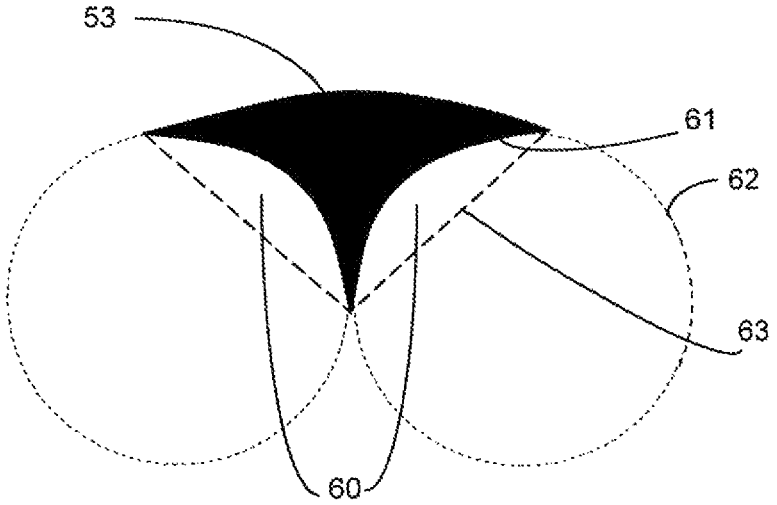
Figure 7:
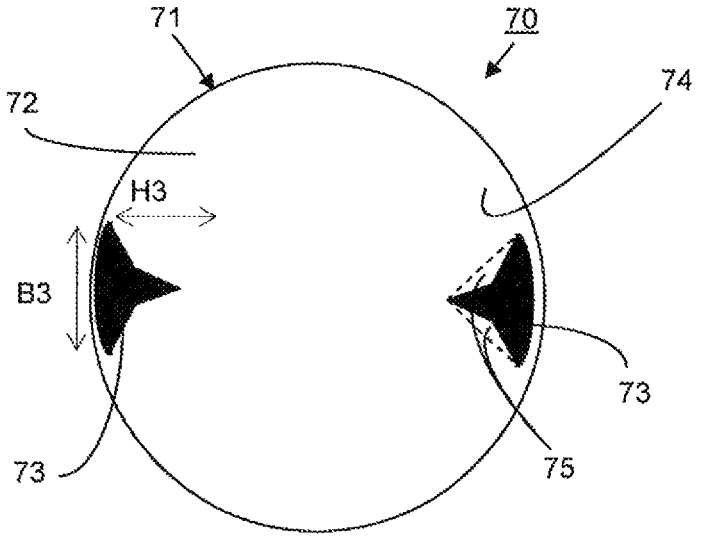
Figure 8:
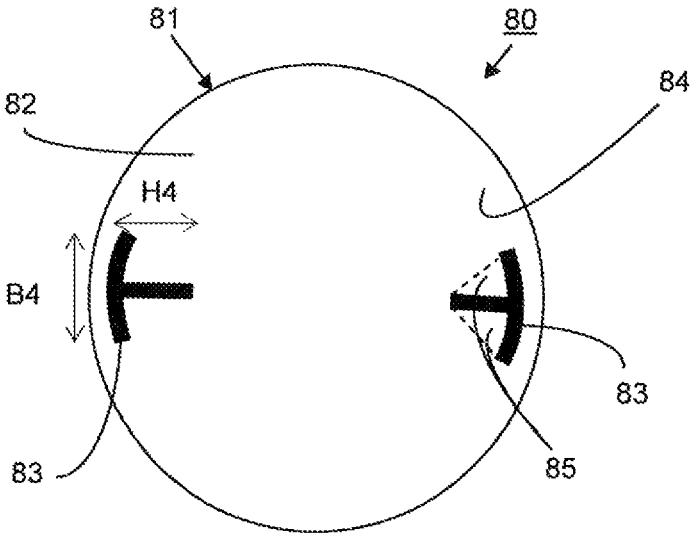
Figure 9:
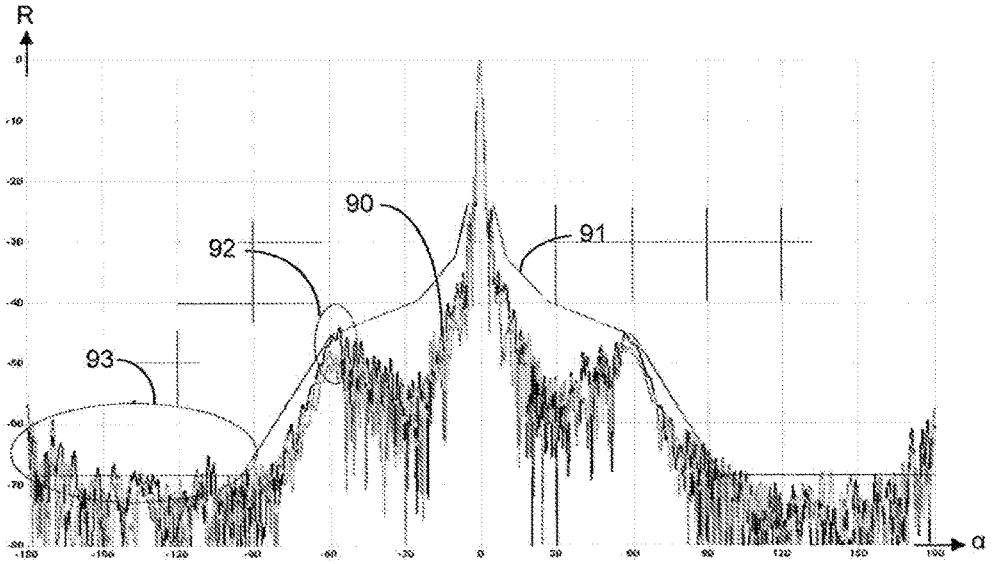
Figure 10:
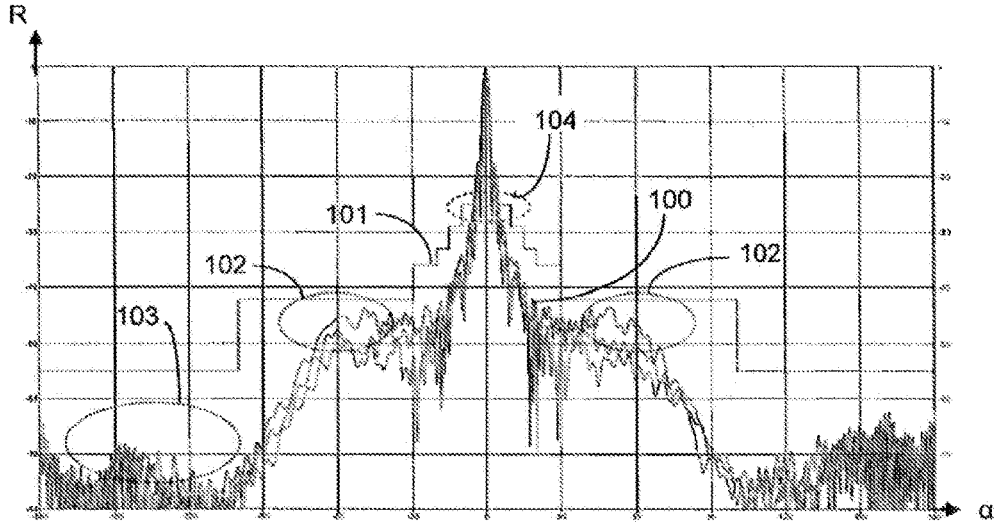
Figure 11:
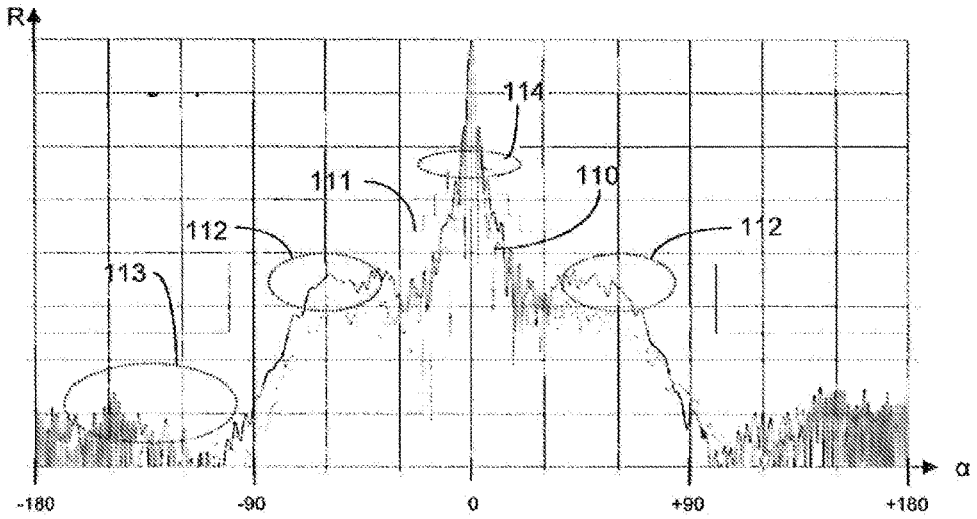

Other characteristics and advantages of the present invention will become apparent upon reading the following description of one embodiment, which is naturally given by way of a non-limiting example, and in the attached drawing, in which:

FIG. 1 schematically depicts a cross-section view of a two-reflector microwave antenna that does not comprise an absorbent shroud, FIG. 2 schematically depicts a cross-section view of a two-reflector microwave antenna according to one embodiment, FIG. 3 schematically depicts the inner surface of a radome according to a first embodiment, FIG. 4 schematically depicts the inner surface of a radome according to a second embodiment, FIG. 5 schematically depicts the inner surface of a radome according to a third embodiment, FIG. 6 schematically depicts in detail the shape of the dielectric part according to the third embodiment, FIG. 7 schematically depicts the inner surface of a radome according to a fourth embodiment, FIG. 8 schematically depicts the inner surface of a radome according to a fifth embodiment, FIG. 9 depicts the radiation pattern in the horizontal plane of an antenna of the prior art that does not comprise a shroud, FIG. 10 depicts the radiation pattern in the horizontal plane of an antenna according to the second embodiment, FIG. 11 depicts the radiation pattern in the horizontal plane of an antenna according to the third embodiment, In FIGS. 9 to 11, the radiation R in dB is given on the y-axis, and the transmission/reception angle $\alpha$ is given on the x-axis.

DETAILED DESCRIPTION

FIG. 1 depicts an antenna 1 comprising a concave primary reflector 2 and a secondary reflector 3. The antenna 1 is fed by a waveguide 4 which may be a hollow metal tube, for example one made of aluminum. The reflectors 2, 3 are protected by a radome 5. This antenna 1 does not comprise an absorbing shroud. The waveguide 4 emits incident radiation in the direction of the secondary reflector 3 which is reflected towards the primary reflector 2, forming the main beam 6 towards the receiver. However, part of the incident radiation is sent back in a divergent direction and causes spillover losses 7. Another part of the radiation is reflected by the primary reflector 2, but this reflected radiation is masked by the secondary reflector 3 which sends it back to the primary reflector 2. It is then reflected by the primary reflector 2 and sent back in a divergent direction, causing losses due to the masking effect 8.

In the embodiment of the invention depicted in FIG. 2, an antenna 10 comprises a concave primary reflector 11 and a secondary reflector 12. The antenna 10 is fed by a waveguide 13. The reflectors 11, 12 are protected by a radome 14. The waveguide 13 emits incident radiation in the direction of the secondary reflector 12, part of which 15 is sent in a divergent direction. Absorbent parts 16 are disposed on the inner surface of the radome 14 along the edge of the primary reflector 11, leaving an empty area in the center of the reflector. The divergent lateral radiation 15 is absorbed by the parts 16 and spillover is thereby avoided, without compromising the other characteristics.

FIG. 3 depicts a first embodiment of a microwave antenna 30 with a concave deep reflector 31 having a circular opening, protected by a radome 32 which here is a rigid flat radome. A ring 33 made of absorbent material whose width H0 is disposed on the inner surface 34 of the radome 32 along the peripheral edge of the reflector 31. The reduction in spillover depends on the weights H0 of the absorbing ring 33. The presence of the absorbing ring 33 makes it possible to significantly reduce spillover losses. However, in the present situation, the impact of the absorbent ring 33 on the gain of the antenna 30 will be relatively high because of the large surface area of the radome covered by the ring, which nonetheless should not exceed 25% of the total surface area, and preferably not exceed 15%. Additionally, the improvement of the radiation pattern of the antenna 30 in the horizontal plane is not preferred by this embodiment. An absorbent part has been described with the shape of a continuous solid ring. However, it is possible to envision, for example, a ring formed of a succession of triangles forming a toothed inner edge.

We shall now consider FIG. 4 which depicts a second embodiment of a microwave antenna 40 having a concave deep reflector 41 and low focal distance (F/D=0.2) protected by a flat rigid radome 42 that is circular in shape. Absorbent parts 43 are placed in a diametrically opposite matter, in order to improve performance in the horizontal plane (azimuth plane) by acting similarly to a shroud. The absorbent parts 43 are disposed on the inner surface 44 of the radome 41 along its periphery, which follows the edge of the reflector 41, leaving an empty area in the center of the reflector.

The absorbent parts 43 have a particular shape: Substantially triangular in this case, with the base of the absorbent part following the edge of the return, which is rounded. The reduction in spillover depends on the height H1 of the absorbent part, and the length B1 of the base of the absorbent part 43 changes the front-to-back ratio of the antenna, meaning the ratio between the radiation level of the main lobe in the front of the antenna and the level of the rear lobe at 180°, in this case in the horizontal plane. The absorbent parts 43 cover at most 15% of the inner surface of the radome 42.

FIG. 5 depicts a third advantageous embodiment of a microwave antenna 50 operating in a high frequency domain (GHz), which comprises a concave deep reflector 51 with a low focal distance (F/D=0.2) protected by a flat rigid radome 52 that is circular in shape. Absorbent parts 53 are disposed on the inner surface 54 of the radome 52 along the periphery of the reflector 51. The absorbent part 53 is made of an absorbent material such as, for example, carbon-impregnated polyurethane foam. For satisfactory operation of the antenna 50 in a 6 GHz to 40 GHz frequency band, the thickness of an absorbent part 53 is less than 20 mm, and preferably on the order of 12 mm.

The absorbent parts 53 are placed in a diametrically opposite manner in order to improve performance in the horizontal plane. The absorbent parts 53 cover at most 15% of the inner surface of the radome 52. Above 15%, the impact of the presence of absorbent parts 53 on the antenna's gain becomes high, and the secondary lobes of the radiation pattern increase. In the present case, the absorbent parts 53 cover about 10% of the inner surface of the radome 52. The front-to-back ratio of the radiation pattern is thereby significantly improved, with little impact on gain (at most 0.3 dB).

The length B2 of the base of the triangular absorbent part 53 is long enough to achieve a high front-to-back ratio. The shape of the base of the absorbent part 53 is adapted to that of the reflector's edge in order to efficiently reduce spillover without it being necessary to increase the height H2 of the absorbent part 53. The height H2 of the absorbent part 53 has a direct impact on the angle domain around 60° of the radiation pattern of a parabolic deep reflector antenna. For example, in the case of a concave reflector having a circular opening with a diameter D, the length of the base B2 is preferably between D/5 and 2D/5. The ratio B2/H2 between the length of the base B2 and the height H2 of the absorbent part 53 is preferably between 1 and 2:1≤B2/H2≤2. These values make it possible to achieve a result in terms of reducing spillover and front-to-back ratio that is substantial and allows such an antenna to be fully satisfactory.

In this embodiment, the absorbent part has the shape of a triangle from which a portion of the surface area has been removed. The particular shape of the absorbent part 53 of a triangle from which some of the side area has been removed is preferably obtained by eliminating rounded areas 60 on each side of the triangle in a cut-out that may be in the shape of a circular arc 61, as depicted in FIG. 6 for example, without altering the height H2 of the absorbent part 53. The rounded area or circular segment 60 is part of a disk 62 defined as a separate domain from the rest of the disk 62 by an intersecting line or chord 63. The circular segment 60 is therefore the part of the disk between the intersecting line 63 and the circular arc 61. The sides of the triangle then form a circular arc. The shape of the absorbent part 53 is calculated in order to achieve a favorable compromise between reducing spillover, improving front-to-back ratio and impact on antenna gain 50. The electromagnetic field value of the main part of the central area of the radome 52 decreases fairly quickly as you move closer to the peripheral edge of the circular radome 52. The particular shape of the absorbent part 53 placed near the edge of the radome 52 makes it possible to create a gradual transition area between the edge and the central area of the radome 52.

The particular shape of the absorbent part is preferably obtained from a substantially triangular shape by eliminating areas from the sides of the triangle so as to reduce the area corresponding to the peak of the triangle while keeping as much area as possible on the base. The absorbent part has a lower surface area than the triangle attaching the base to the peak. This shape is obtained by a cut-out that may particularly be in the shape of a circular arc 61 as depicted in FIGS. 5 and 6, or in the shape of a Gauss curve, or in any other shape that makes it possible to achieve the desired goal, such as a triangle as in FIG. 7 or a rectangle as in FIG. 8, for example.

FIG. 7 depicts a fourth embodiment of a microwave antenna 70 having a circular concave reflector 71 protected by a flat rigid radome 72 that is circular in shape. Absorbent parts 73 are disposed on the inner surface 74 of the radome 72. The absorbent part 73 has substantially the shape of a triangle with height H3 and base length B3 from which areas 75 have been removed from the sides by a substantially triangular cut-out. The sides of the triangle form an inside corner. The base of the absorbent part 73 is rounded so as to match the edge shape of the circular opening of the reflector 72.

FIG. 8 depicts a fifth embodiment of a microwave antenna 80 having a circular concave reflector 81 protected by a flat rigid radome 82 that is circular in shape. Absorbent parts 83 are disposed on the inner surface 84 of the radome 82. The absorbent part 83 has substantially the shape of a T with a rounded head so as to match the edge shape of the circular opening of the reflector 82, with height H4 and base length B4. It deviates from the triangular shape by the removal of areas 85 in a cut-out substantially shaped like an isosceles triangle, in particular a right isosceles triangle.

FIG. 9 depicts the radiation of a deep reflector antenna having a front-to-back ratio of 0.2. The main reflector of this antenna of the prior art does not comprise a shroud. The curve 90 depicts the radiation pattern in the 10 GHz frequency band of the primary reflector in the horizontal plane. The reference curve 91 represents the standard profile corresponding to the ETSI class 3 model. The areas 92 correspond to mediocre performance due to a high level of spillover losses. In the areas 93, the side lobes exceed the ETSI standard. In the absence of a shroud, the direct consequence is that the radiation pattern has high spillover peaks in the angular areas 92 corresponding to the edges of the primary parabolic reflector, and an increase in the side lobes corresponding to the areas 93.

FIG. 10 depicts the radiation of a deep-reflector antenna in which the radome comprises absorbent parts according to the second embodiment. The curve 100 depicts the radiation pattern in the 10 GHz frequency band of the primary reflector in the horizontal plane. The reference curve 101 represents the standard profile corresponding to the ETSI class 3 model. The areas 102 correspond to the reflector's edge, where less spillover occurs than in the previous figure. The areas 103 correspond to the side lobes, which are greatly diminished. Unlike the radiation pattern depicted by FIG. 7, the values of the radiation pattern here remain within the maximum values permitted by the ETSI class 3 model, despite the absence of a shroud.

FIG. 11 depicts the radiation pattern of a deep reflector antenna in which the radome comprises absorbent parts according to the third embodiment. The curve 110 depicts the radiation pattern in the 10 GHz frequency band of the primary reflector in the horizontal plane. The reference curve 111 represents the standard profile corresponding to the ETSI class 3 model. The areas 112 correspond to the reflector's edge, where the spillover and the areas 113 correspond to the side lobes.

When comparing the curves 100 and 110, which respectively relate to the embodiments of FIGS. 4 and 5, it is observed that the thickness of the main lobe in the central area 104, 114 of the radiation pattern increases with the surface area of the triangle.

Naturally, the present invention is not limited to the described embodiments, but is, rather, subject to many variants accessible to the person skilled in the art without departing from the spirit of the invention. In particular, it is possible, without departing from the scope of the invention, to modify the number and shape of the absorbent parts. The described embodiments comprise either an annular absorbent part, or two absorbent parts in diametrically opposite positions. It is possible to use a higher even number (4, 6, 8, etc.) of absorbent parts depending on the acceptable compromise between the reduction of spillover losses and the impact on the antenna's gain. Multiple shapes of the absorbent part have been described in a non-limiting fashion, nonetheless it is possible to use different shapes obtained by removing side surfaces of various shapes.

The invention claimed is:

1. An antenna comprising: a concave reflector having a circular opening with a peripheral edge, the reflector being protected by a radome fixed directly onto the peripheral edge of the reflector, the radome comprising an inner surface facing the reflector, the inner surface of the radome comprising at least one absorbent part and disposed along the peripheral edge of the reflector, wherein the at least one absorbent part is embedded in an area of the inner surface facing the reflector and has a substantially triangular shape of which the point is directed towards the center of the reflector and a base is rounded along the peripheral edge of the reflector.

2. An antenna according to claim 1, wherein the surface area of the radome covered by the absorbent part(s) is less than 15% of the total surface area of the inner surface of the radome.

3. An antenna according to claim 1, wherein the absorbent part has a lower surface area than the triangle attaching the base to the peak.

4. An antenna according to claim 1, comprising at least two absorbent parts in diametrically opposite positions.

5. An antenna according to claim 1, wherein the absorbent parts are disposed in a ring formed of a succession of triangles.

6. An antenna according to claim 3, wherein the absorbent part substantially has the shape of a triangle from which some of the side surface area has been removed.

7. An antenna according to claim 4, wherein the sides of the triangle form a circular arc.

8. An antenna according to claim 4, wherein the sides of the triangle form an inside corner.

9. An antenna according to claim 1, wherein the length of the absorbent part's base is between D/5 and 2D/5 where D is the diameter of the radome.

10. An antenna according to claim 3, wherein the ratio of the length of the absorbent part's base to the absorbent part's height is between 1 and 2.

11. An antenna according to claim 1, wherein the radome is flat, rigid, and circular.

* * * * *